US010465704B2

(12) United States Patent
Khalitov et al.

(10) Patent No.: US 10,465,704 B2
(45) Date of Patent: Nov. 5, 2019

(54) MEDIA CONCENTRATION DEVICE AND METHOD

(71) Applicant: Twin City Fan Companies, Ltd., Plymouth, MN (US)

(72) Inventors: Daniel Khalitov, St. Louis Park, MN (US); Radha Krishna Ganesh, Rogers, MN (US)

(73) Assignee: Twin City Companies, Ltd., Plymouth, MN (US)

( * ) Notice: Subject to any disclaimer, the term of this patent is extended or adjusted under 35 U.S.C. 154(b) by 240 days.

(21) Appl. No.: 15/358,545

(22) Filed: Nov. 22, 2016

(65) Prior Publication Data

US 2017/0146023 A1 May 25, 2017

Related U.S. Application Data

(60) Provisional application No. 62/342,239, filed on May 27, 2016, provisional application No. 62/259,904, filed on Nov. 25, 2015.

(51) Int. Cl.
*F04D 29/44* (2006.01)
*F25C 3/04* (2006.01)
(Continued)

(52) U.S. Cl.
CPC ..... *F04D 29/44* (2013.01); *F04D 13/12* (2013.01); *F04D 25/06* (2013.01); *F04D 29/02* (2013.01); *F04D 29/22* (2013.01); *F04D 29/542* (2013.01); *F04D 29/544* (2013.01); *F04D 29/705* (2013.01); *F04D 31/00* (2013.01);
(Continued)

(58) Field of Classification Search
CPC ..... F04D 29/44; F04D 25/06; F04D 29/02; F04D 29/22; F04D 29/544; F04D 29/705; F04D 29/542; F04D 13/12; F04D 31/00; F25C 3/04; F25C 2303/046; F25C 2303/048; F05D 2240/121; F05D 2300/603
See application file for complete search history.

(56) References Cited

U.S. PATENT DOCUMENTS 6,691,926 B1 2/2004 Moen
2004/0076515 A1 4/2004 Hsieh
(Continued)

FOREIGN PATENT DOCUMENTS

WO WO-2017091666 A1 6/2017

OTHER PUBLICATIONS

"International Application Serial No. PCT/US2016/063493, International Preliminary Report on Patentability dated Jun. 7, 2018", 8 pgs.

(Continued)

*Primary Examiner* — Hieu T Vo
*Assistant Examiner* — Arnold Castro
(74) *Attorney, Agent, or Firm* — Schwegman Lundberg & Woessner, P.A.

(57) ABSTRACT

An air flow assembly, such as a fan assembly, and associated methods are shown that may include one or more media dispensing nozzles. Examples of assemblies and methods are shown that include nozzles located within hollow vanes. Other examples of fan assemblies and methods are shown that create multiple cross sectional vortices that may be useful to concentrate a dispersed media.

21 Claims, 8 Drawing Sheets

(51) Int. Cl.

| | |
|---|---|
| ***F04D 29/22*** | (2006.01) |
| ***F04D 31/00*** | (2006.01) |
| ***F04D 13/12*** | (2006.01) |
| ***F04D 29/02*** | (2006.01) |
| ***F04D 25/06*** | (2006.01) |
| ***F04D 29/54*** | (2006.01) |
| ***F04D 29/70*** | (2006.01) |

(52) U.S. Cl.
CPC ..... *F25C 3/04* (2013.01); *F05D 2240/121* (2013.01); *F05D 2300/603* (2013.01); *F25C 2303/046* (2013.01); *F25C 2303/048* (2013.01)

(56) References Cited

U.S. PATENT DOCUMENTS

2005/0159101 A1* 7/2005 Hrdina ..... F04D 25/02 454/356
2005/0159102 A1* 7/2005 Seliger ..... B08B 15/002 454/356
2006/0151633 A1 7/2006 Presz, Jr. et al.
2009/0155064 A1* 6/2009 Brown ..... F04D 29/44 415/199.6
2009/0245999 A1 10/2009 Flodman et al.
2011/0277271 A1 11/2011 Guo et al.
2013/0011239 A1 1/2013 Khalitov et al.
2013/0098045 A1 4/2013 Binek et al.
2016/0356278 A1* 12/2016 Khalitov ..... F04D 25/082
2016/0356287 A1* 12/2016 Khalitov ..... F04D 25/082

OTHER PUBLICATIONS

"International Application Serial No. PCT/US2016/063493, International Search Report dated Mar. 24, 2017", 2 pgs.
"International Application Serial No. PCT/US2016/063493, Written Opinion dated Mar. 24, 2017", 6 pgs.

* cited by examiner

MEDIA CONCENTRATION DEVICE AND METHOD

RELATED APPLICATIONS

This application claims the benefit of priority to U.S. Provisional Patent Application Ser. No. 62/342,239, filed May 27, 2016, and U.S. Provisional Patent Application Ser. No. 62/259,904, filed Nov. 25, 2015 and, the contents of which are incorporated herein by reference in their entireties.

TECHNICAL FIELD

Embodiments described herein generally relate to fan assemblies and devices that utilize fan assemblies. Specific embodiments may include media dispensing nozzles, and be configured to create vortices.

BACKGROUND

Fans may be used for a number of applications. One application may include utilizing a fan to blow a media, such as a liquid or a solid in a desired direction. In one example, a snow making machine blows water into the air, where it freezes in to snow. In another example, water is blown into a dusty environment, where the water traps the dust and removes it from the air. In another example, leaves may be blown into a pile with greater accuracy and greater distance. Improved control of air from such fans is desired. Improved media dispersal fan arrangements are desired.

DESCRIPTION OF EMBODIMENTS

Figure 1:
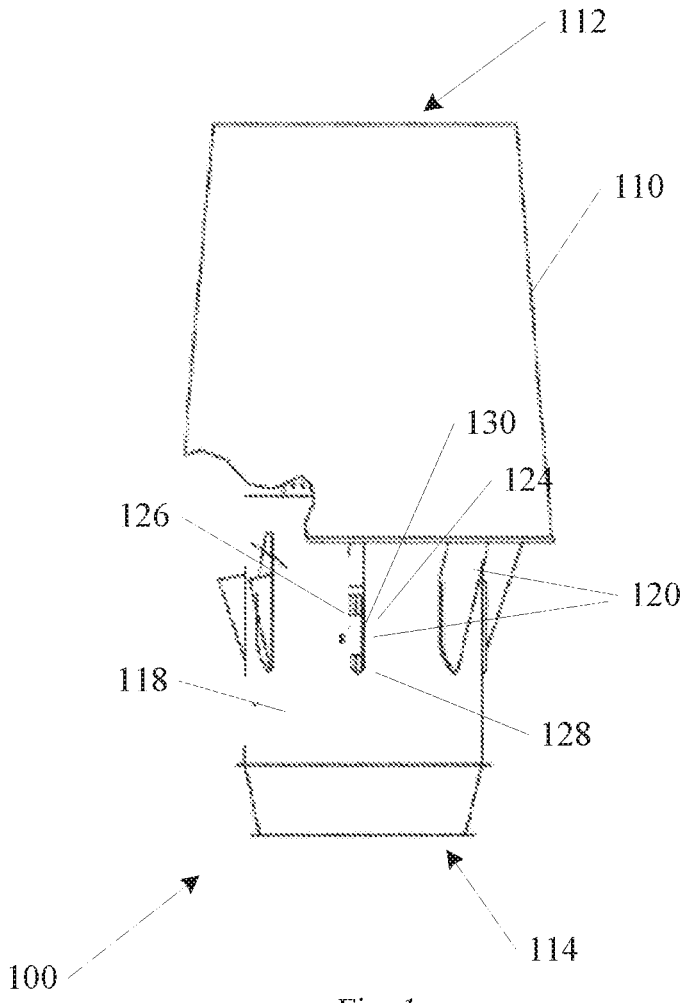
FIG. 1 shows a side view of a fan assembly according to an example of the invention.

In the following detailed description, reference is made to the accompanying drawings which form a part hereof, and in which is shown, by way of illustration, specific embodiments in which the invention may be practiced. In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention.

FIG. 1 shows one example of a fan assembly 100. The fan assembly includes an inlet 114, and an outlet 112. A flow housing 118 is located between the inlet 114 and the outlet 112. A number of vanes 120 are located within a flow housing 118. In the example of FIG. 1, a windband 110 may be further coupled above the flow housing 118, although the invention is not so limited. The vanes 120 are shown spaced about the flow housing 118. A first vane side 124, a second vane side 126, and a vane tip 128 define a hollow space within the vane 120 that allows external air to enter a motor housing and/or a flow space 117 shown in more detail in FIG. 2. A portion of the motor 130 can be seen through one of the hollow vanes 120.

Figure 2:
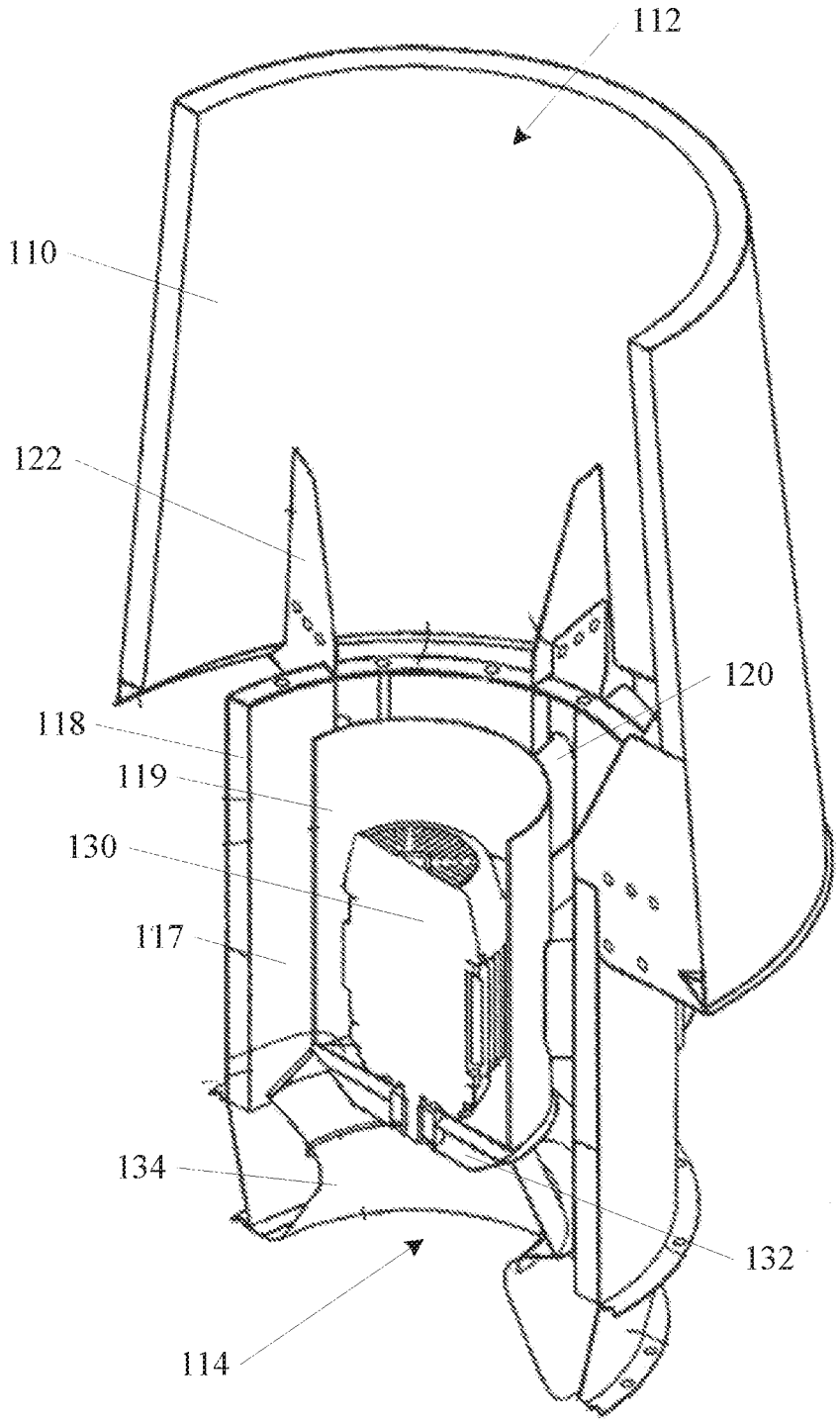
FIG. 2 shows a cross section view of a fan assembly according to an example of the invention.

FIG. 2 shows a cross section view of an example fan assembly 100 from FIG. 1. An impeller 132 is shown that is coupled to a motor 130. In the example shown, the motor 130 is housed within an interior space of the flow housing 118. FIG. 2 shows a motor housing 119 that is located within the flow housing 118, and defining a flow space 117 located between the flow housing 118 and the motor housing 119. FIG. 2 further shows the number of vanes 120 located within the flow space 117, and bridging between an inner diameter of the flow housing 118 to an outer diameter of the motor housing 119.

In one example, one or more components of the fan assembly 100 are formed from carbon fiber composite material. Example components that may be formed from carbon fiber composite material include, but are not limited to, the flow housing 118; the motor housing 119; the windband 110, and the vanes 120. Carbon fiber composite material has a high strength to weight ratio, and is very resilient. Advantages of forming one or more components from carbon fiber composite material include decreased weight, that provides ease of moving the fan assembly 100, and increased safety. The toughness of carbon fiber composite material, and resistance to catastrophic failure will better contain foreign objects within the housing(s) 118, 119, or windbands 110, etc. such as rocks or ice chunks that may be accidentally drawn into the impeller during operation. Carbon fiber composite components such as housing(s) 118, 119, or windbands 110 will also better contain any broken components such as fragments of impeller in the case of a breakage due to a foreign object.

In one example, the vanes 120 are hollow vanes, as will be discussed in more detail below. In selected examples, hollow vanes 120 may permit air to flow between the inner diameter of the flow housing 118 the motor 130, located within the motor housing 119. In one example, hollow vanes 120 may provide access to an interior of the vanes 120 to supply a media to a nozzle located within one or more of the hollow vanes 120. Nozzle location and operation are described in more detail in examples below.

In one example, the vanes 120 are asymmetric. As will be described in more detail below, asymmetric vanes 120 provide a number of advantages, including, but not limited to noise reduction as a result of reducing harmonics in the fan assembly. In one example, asymmetric vanes are configured to generate multiple cross sectional vortices at a downstream end of the fan assembly 100. One advantages of multiple cross sectional vortices includes the ability to focus a stream of media that is injected into air flow from the fan assembly 100.

In one example, the asymmetric vanes include substantially identical vanes that are asymmetrically located with respect to one another. In one example, the asymmetric vanes include vanes with different geometries that are symmetrically located with respect to one another. In one example, the asymmetric vanes include vanes with different geometries that are asymmetrically located with respect to one another. In other words, the asymmetry may be in vane geometry, vane location or both vane geometry and vane location.

Figure 3A:
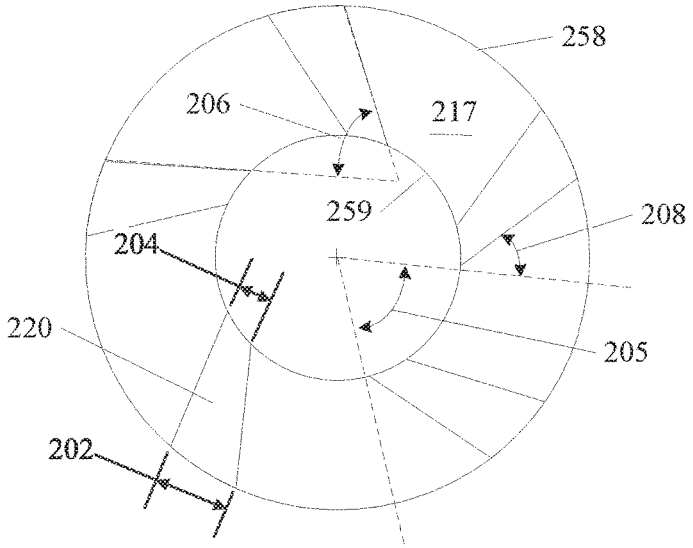
FIG. 3A shows a top view of a portion of a fan assembly according to an example of the invention.
Figure 3B:
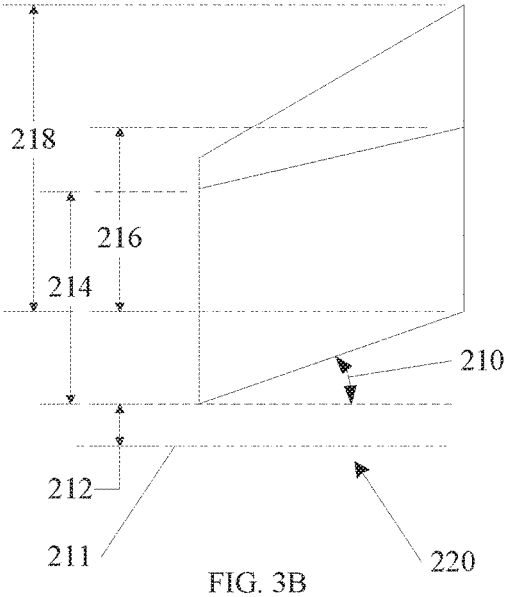
FIG. 3B shows a side view of a vane according to an example of the invention.
Figure 3C:
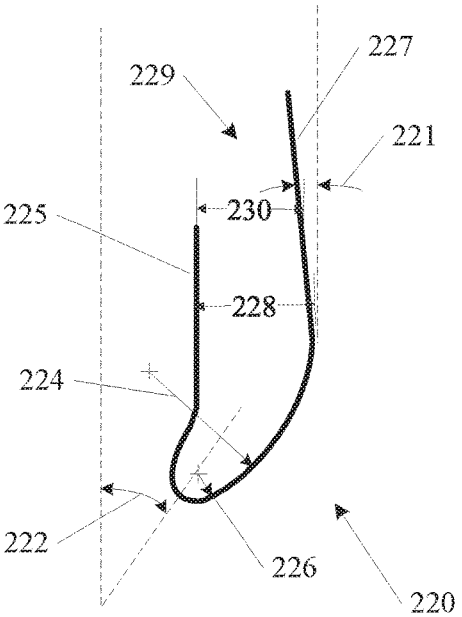
FIG. 3C shows an end view of a vane according to an example of the invention.

FIGS. 3A-3C illustrate a number of vane dimensions that may be varied to provide asymmetric vanes within the fan assembly 100. FIG. 3A shows a number of vanes 220, similar to previously described vanes 120, spaced within a flow space 217. In the example shown, the flow space 217 is defined between a motor housing 259 and a flow housing 258. As discussed above, in one example, the vanes 220 are asymmetric vanes, which may provide advantages such as reduced fan noise and/or creation of multiple cross sectional vortices at a downstream end of the fan assembly 100.

In one example of asymmetric vanes, an angle 205 between vanes 220 is asymmetric. In one example of asymmetric vanes, a sweep angle 208 from one vane to another is asymmetric. In one example of asymmetric vanes, an angle between leading edge centerlines 206 from one vane to another is asymmetric. In one example of asymmetric vanes, an inner vane thickness 204 from one vane to another is asymmetric. In one example of asymmetric vanes, an outer vane thickness 202 from one vane to another is asymmetric.

FIG. 3B shows other examples of vane dimensions that may be varied to provide asymmetric vanes. In one example, a vane offset height 212 from a motor plane line 211 is varied from one vane to another. In one example, a first vane length 214 is varied from one vane to another. In one example, a second vane length 216 is varied from one vane to another. In one example, a third vane length 218 is varied from one vane to another. In one example, a vane yaw angle 210 is varied from one vane to another.

FIG. 3C shows other examples of vane dimensions that may be varied to provide asymmetric vanes. The vane 220 shown in the Figure includes a first vane side 225 and a second vane side 227, with an open trailing edge 229 of the vane 220. In one example, the open trailing edge 229 may be used in conjunction with one or more nozzles as describe in FIG. 4.

In one example, a trailing edge angle 221 is varied from one vane to another. In one example, a leading edge angle 222 is varied from one vane to another. In one example, a camber line radius 224 is varied from one vane to another. In one example, a leading edge curvature radius 226 is varied from one vane to another. In one example, a vane thickness 228 at a vane midsection is varied from one vane to another. In one example, a vane thickness 230 at vane length 216 is varied from one vane to another.

Figure 4:
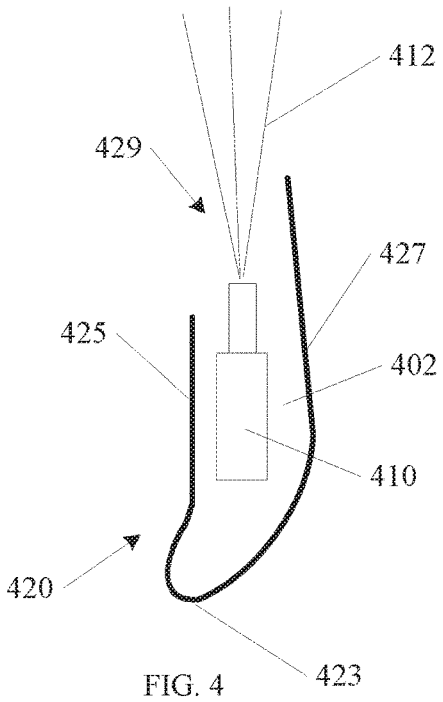
FIG. 4 shows another end view of a vane according to an example of the invention.

FIG. 4 shows a cross section of an example vane 420, similar to vanes 220 and 120 from Figures above. The vane 420 includes a first vane side 425 and a second vane side 427. A leading edge 423 and a trailing edge 429 are shown. In the example of FIG. 4, the trailing edge 429 is open. The vane 420 is a hollow vane, with an interior space 402.

In one example a nozzle 410 is located within the interior space 402 of the vane 420. In one example, the nozzle 410 is configured for delivery of a media 412, shown in FIG. 4 spraying from the nozzle 410. Examples of media may include, but are not limited to, water, super cooled water, a chemical nucleating agent and/or mixtures of media such as super cooled water and a nucleating agent. Other media may include any liquid or gas suitable for targeted distribution using fan systems described in the present disclosure. In one example, a fan system equipped with one or more nozzles may include a snow making system. In one example, a fan system equipped with one or more nozzles may include a dust suppression system.

By including the nozzle 410 within a hollow vane 420 that has an open trailing edge 429, a media 412 can be delivered within an airstream generated by a fan system, while minimally disrupting air flow around the vanes 420. Further, when nozzles 410 are located within vanes 420 they take up less space, and the associated fan assembly can be made more compact.

Although FIG. 4 shows a nozzle 410 located within a vane 420, the invention is not so limited. Other examples include nozzles 410 that are located elsewhere within a fan assembly that utilize the concept of multiple cross sectional vortices that are described in more detail with respect to FIG. 6 below.

Figure 5:
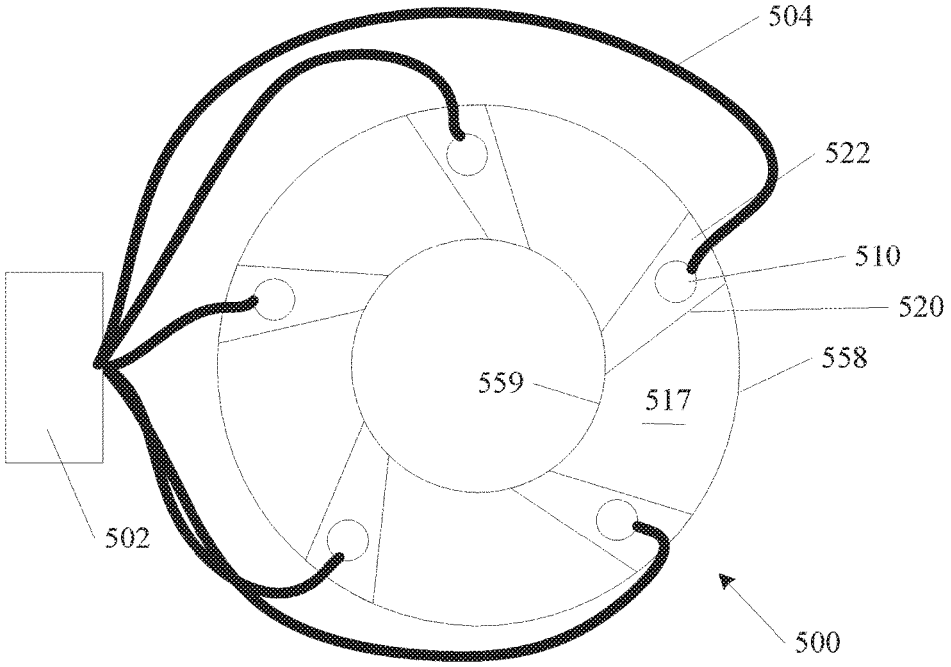
FIG. 5 shows a top view of a portion of a fan assembly according to an example of the invention.

FIG. 5 shows an example fan assembly 500 according to an embodiment of the invention. FIG. 5 shows a number of vanes 520, similar to previously described vanes 120, 220, 420, spaced within a flow space 517. In the example shown, the flow space 517 is defined between a motor housing 559 and a flow housing 558. As discussed above, in one example, the vanes 520 are asymmetric vanes, which may provide advantages such as reduced fan noise and/or creation of multiple cross sectional vortices at a downstream end of the fan assembly 500.

A number of nozzles 510 are shown located within vanes 520 of the fan assembly 500. Although in FIG. 5, all vanes 520 include a respective nozzle 510, the invention is not so limited. Other examples may include fewer nozzles 510 that vanes 520, for example, a nozzle 510 in every other vane, or some other configuration with fewer nozzles 510 than vanes 520.

The vanes 520 in FIG. 5 are hollow vanes, and have an opening 522 through the flow housing 558 that permits access to nozzles 510 that are located within the vanes 520. In the example shown, a number of media supply lines 504 are coupled to the nozzles 510 through the openings 522, and are configured to transmit a selected media, or mixture of media from a supply 502, through the media supply lines 504, to the nozzles 510. Although the invention is not limited to configurations with nozzles 510 located within hollow vanes 520, this configuration provides advantages such as a more compact design and more streamlined air flow over the vanes 520 because the nozzles are sheltered within the vanes, while the media is introduced to airflow through open trailing edges of vanes 520.

Figure 6:
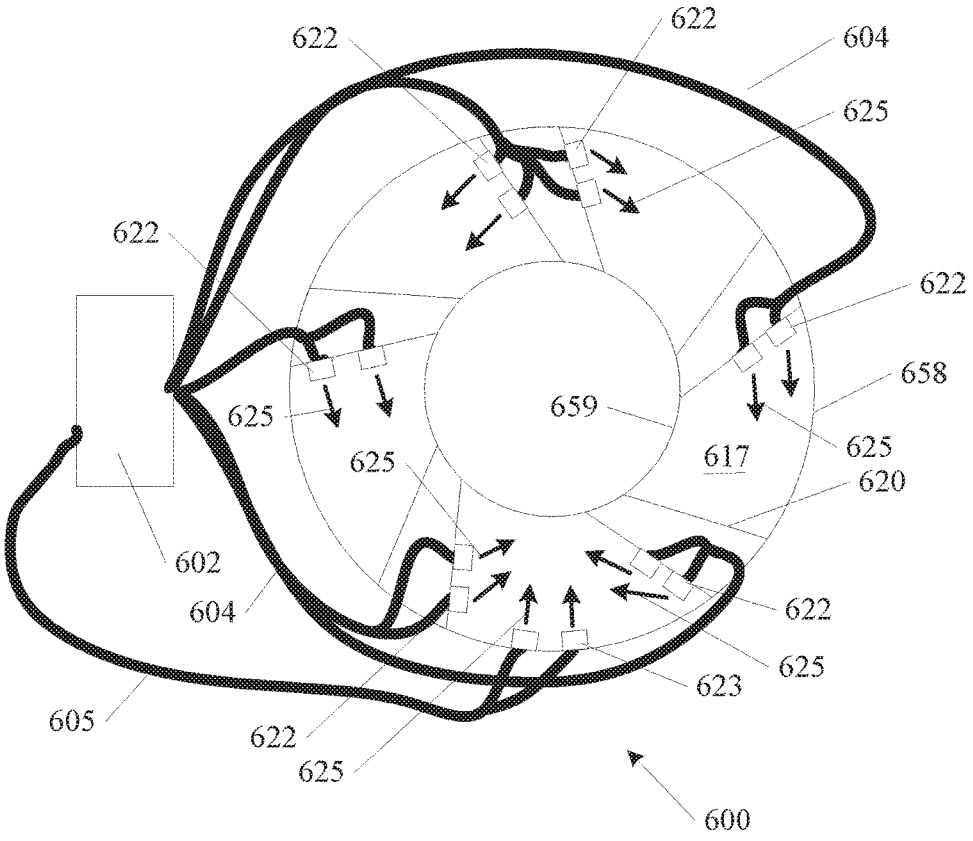
FIG. 6 shows another top view of a portion of a fan assembly according to an example of the invention.

FIG. 6 shows an example fan assembly 600 according to an embodiment of the invention. FIG. 6 shows a number of vanes 620, similar to previously described vanes 620, 620, 620, and 520, spaced within a flow space 617. In the example shown, the flow space 617 is defined between a motor housing 659 and a flow housing 658. As discussed above, in one example, the vanes 620 are asymmetric vanes, which may provide advantages such as reduced fan noise and/or creation of multiple cross sectional vortices at a downstream end of the fan assembly 600.

In one example, the vanes 620 may include hollow vanes as described in examples above. A number of nozzles 622 are shown. In the example of FIG. 6, the number of nozzles 622 are coupled to a surface of the vanes 620 within the flow space 617. In the example shown, the number of nozzles 622 are arranged within the flow space 617 in a configuration to generate multiple cross sectional vortices at a downstream end of the fan assembly 600. For example, arrows show a direction of spray 625 for nozzles 622. The direction of spray 625 moves air and/or media around in converging direction's towards the bottom of the Figure in FIG. 6. When the spray from either side of the fan assembly 600 meets at the bottom of the Figure, the air flow is directed upwards into two cross sectional vortices as the flow exits at a downstream end of the fan assembly 600. Although two vortices are used as an example, it will be appreciated that other nozzle 622 arrangements can be used to generate other numbers of vortices, such as three, four. etc.

In one example, nozzles 623 are used to deliver a different media type from the media delivered by nozzles 622. In one example, nozzles 622 deliver water, and nozzles 623 deliver a nucleating agent, such as a particulate. In one example, the water and nucleating agent may be combined in operation to form a snow making machine. Although the locations of nozzles 622 and 623 are specifically shown in FIG. 6, the locations are examples only. In other examples, nucleating agents and water may be introduced at other locations within the flow space 617.

In the example shown, a number of media supply lines 604 are coupled to the nozzles 622, and are configured to transmit a selected media, or mixture of media from a supply 602, through the media supply lines 604, to the nozzles 622. In one example, a separate supply line 605 is used to supply a secondary media, such as a nucleating agent.

Figure 7A:
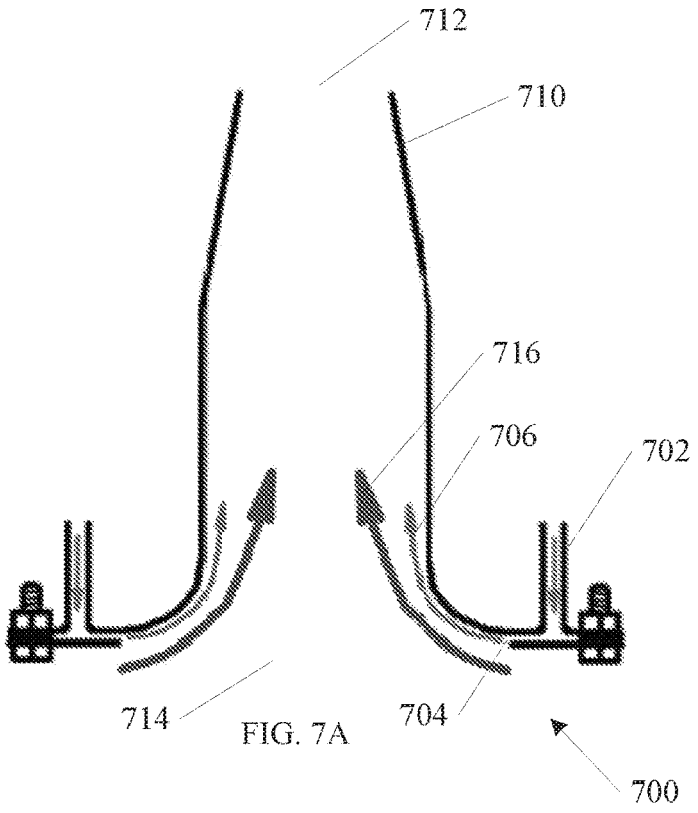
FIG. 7A shows a side view of a portion of an air flow device according to an example of the invention.

FIG. 7A shows an air flow device 700 according to one example. A number of nozzles 702 are located around a periphery of a housing 710. The housing 710 includes an outlet 712 and an inlet 714. In one example steam is injected at high pressure along arrows 706 into the housing 710 near the inlet 714. Due to the high velocity of the steam, external air is drawn into the inlet along arrows 716. In a snow making example, the external air may cool the steam to turn it into snow. In one example, one or more nozzles 702 may provide a nucleating agent. In one example, one or more nozzles 702 may provide steam. In one example, steam and a nucleating agent may be mixed, and injected through the same nozzle.

Figure 7B:
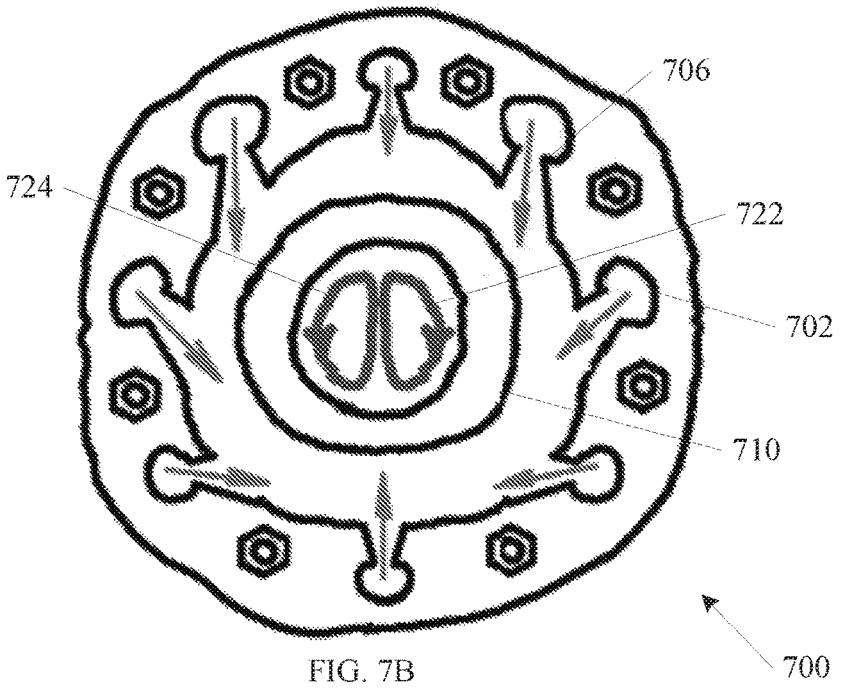
FIG. 7B shows a top view of a portion of the air flow device from FIG. 7A according to an example of the invention.

FIG. 7B shows a top view of the air flow device 700 from FIG. 7A. The number of nozzles 702 are shown arranged in specific directions to provide multiple cross sectional vortices at the outlet 712 of the housing 710. The steam is injected at high pressure along arrows 706, which moves the steam and/or mixing external air around in converging direction's towards the bottom of the Figure in FIG. 7B. When steam from either side of the air flow device 700 meets at the bottom of the Figure, the air flow is directed upwards into two cross sectional vortices 722, 724 as the flow exits at the outlet 712 of the housing 710.

Figure 8A:
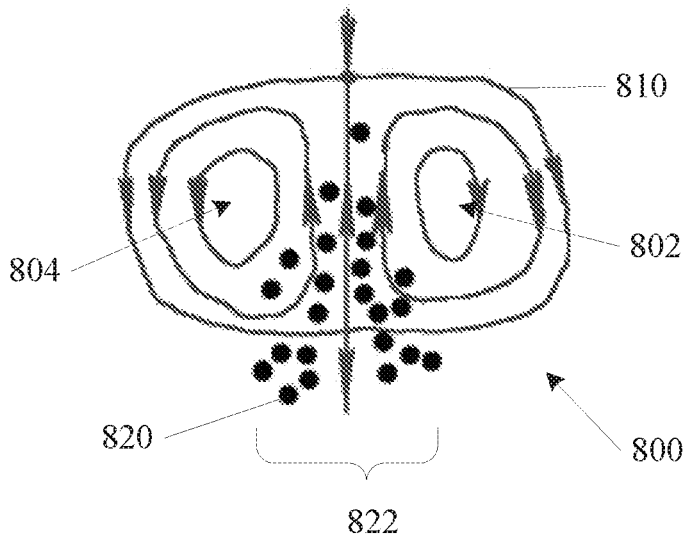
FIG. 8A shows a diagram of air flow according to an example of the invention.

FIG. 8A shows an example diagram 800 of multiple cross sectional vortices that may be created using configurations described above, such as selected configurations of asymmetric vanes. The diagram 800 includes flow lines 810 that indicate direction of air flow. The example diagram 800 of FIG. 8A illustrates two cross sectional vortices, although the invention is not so limited. More than two cross sectional vortices may be created in other examples. FIG. 8A shows a first vortex 802, and a second vortex 804 that are formed adjacent to one another at a discharge region of a fan assembly as described in examples above. As a result of the multiple cross sectional vortices, any media 820 introduces within the vortices 802, 804 is concentrated in a central region 822. Using a snow making device as an example fan assembly, concentration of media, such as super cooled water, in a central region 822 can be advantageous if a pile of snow is desired in one particular location. Additionally, by concentrating media within the central region 822, the air flow from the fan assembly may carry the media a larger distance from the fan assembly than if the media were allowed to randomly disperse as it exited the fan assembly.

Figure 8B:
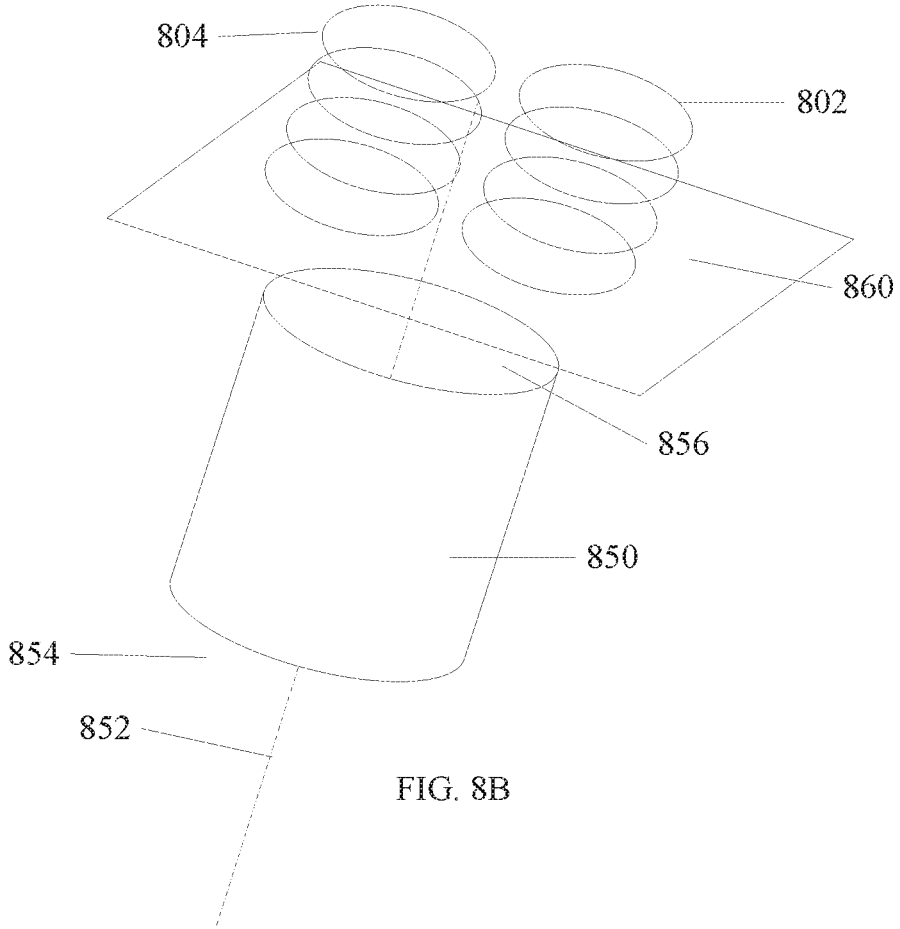
FIG. 8B shows a block diagram of a fan assembly generating multiple cross sectional vortices according to an example of the invention.

To further illustrate the diagram 800 of FIG. 8A, FIG. 8B shows a block diagram of a fan 850 having a central axis 852, An air inlet side 854 of the fan 850 is shown, along with an air discharge region 856. A cross sectional plane 860 is shown to illustrate the example plane indicated by diagram 800 in FIG. 8A. The first vortex 802 and the second vortex 804 are shown exiting the discharge region 856, and traveling away from the fan 850.

Although asymmetric vanes are discussed as a technique used to generate multiple cross sectional vortices, the invention is not so limited. In another example of a vortex generation modifier, a number of deflectors may be located within the fan assembly or at the discharge region 856 of the fan. In another example, the nozzles may be angled to swirl the air flow as the media is introduced, creating multiple cross sectional vortices. In another example, multiple fans may be used, such as counter rotating fans located side by side to create multiple cross sectional vortices.

Figure 9:
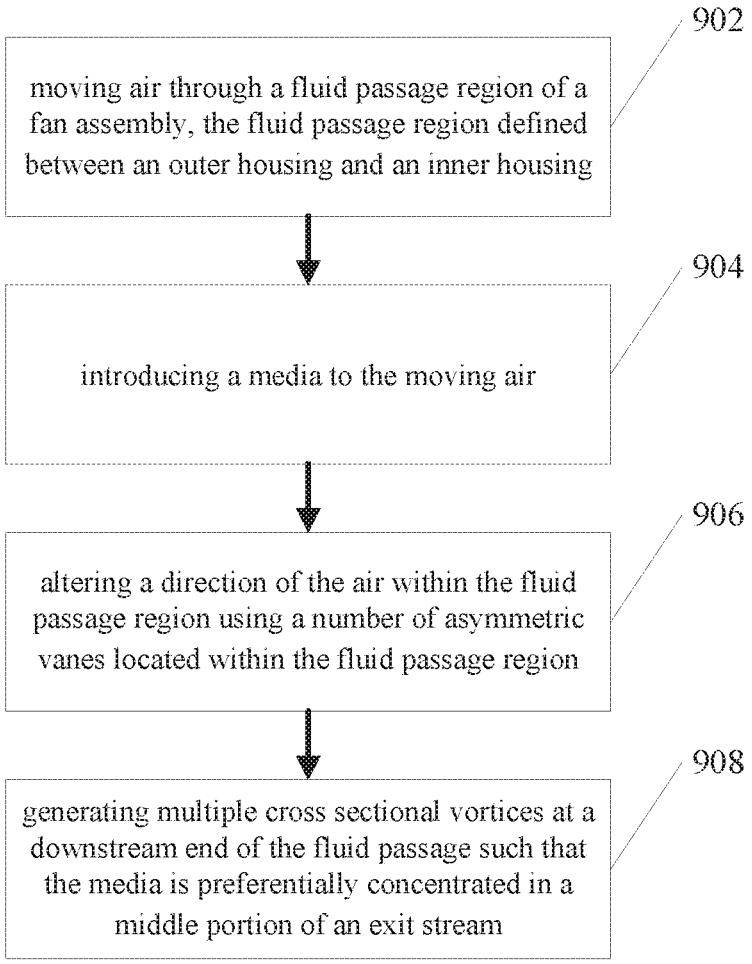
FIG. 9 shows an example method of operation according to an example of the invention.

FIG. 9 shows a flow diagram of an example method according to an embodiment of the invention. In operation 902, air is moved through a fluid passage region of a fan assembly, the fluid passage region defined between an outer housing and an inner housing. In operation 904, media is introduced to the moving air. In operation 906, a direction of the air within the fluid passage region is altered using a number of asymmetric vanes located within the fluid passage region. Lastly, in operation 908, multiple cross sectional vortices are generated at a downstream end of the fluid passage such that the media is preferentially concentrated in a middle portion of an exit stream.

To better illustrate the method and apparatuses disclosed herein, a non-limiting list of embodiments is provided here:

Example 1 includes a fan assembly, including a fluid passage region defined between an outer housing and an inner housing, a fan motor located within the inner housing, an impeller coupled to the fan motor to drive a fluid through the fluid passage region, a number of hollow vanes located within the fluid passage region to direct a fluid flow through the fluid passage region, and one or more nozzles located substantially within at least one of the hollow vanes having an outlet positioned to dispense a media within the fluid passage region.

Example 2 includes the fan assembly of example 1 wherein the one or more nozzles are positioned to dispense the media from an open trailing edge of at least one of the hollow vanes.

Example 3 includes the fan assembly of any one of examples 1-2, wherein the one or more nozzles are configured to dispense a liquid.

Example 4 includes the fan assembly of any one of examples 1-3, wherein the one or more nozzles are configured to dispense a super cooled liquid.

Example 5 includes the fan assembly of any one of examples 1-4, wherein the one or more nozzles are configured to dispense water.

Example 6 includes the fan assembly of any one of examples 1-5, wherein the one or more nozzles are configured to dispense pressurized air.

Example 7 includes the fan assembly of any one of examples 1-6, wherein the one or more nozzles are configured to dispense solid particles.

Example 8 includes the fan assembly of any one of examples 1-7, wherein the one or more nozzles are configured to dispense both liquid and solid particle media.

Example 9 includes the fan assembly of any one of examples 1-8, wherein the one or more nozzles are configured for use as a snow making device.

Example 10 includes the fan assembly of any one of examples 1-9, wherein the one or more nozzles are configured for use as a dust suppression device.

Example 11 includes the fan assembly of any one of examples 1-10, wherein one or more of the inner and outer housing is formed from carbon fiber composite material.

Example 12 includes a fan assembly, including a fluid passage region defined between an outer housing and an inner housing, a fan motor located within the inner housing, an impeller coupled to the fan motor to drive a fluid through the fluid passage region, a number of vanes located within the fluid passage region to direct a fluid flow through the fluid passage region, and a vortex generation modifier configured to generating multiple cross sectional vortices at a downstream end of the fluid passage region.

Example 13 includes the fan assembly of example 12 wherein the vortex generation modifier includes a number of asymmetric vanes.

Example 14 includes the fan assembly of any one of examples 12-13, wherein the vortex generation modifier includes a number of nozzles arranged at angles relative to the fluid passage region.

Example 15 includes the fan assembly of any one of examples 12-14, wherein the vortex generation modifier includes multiple fans to generate the multiple cross sectional vortices.

Example 16 includes the fan assembly of any one of examples 12-15, wherein the vortex generation modifier includes one or more deflectors.

Example 17 includes the fan assembly of any one of examples 12-16, wherein one or more of the inner and outer housing is formed from carbon fiber composite material.

Example 18 includes a method of dispensing a media, including moving air through a fluid passage region of a fan assembly, the fluid passage region defined between an outer housing and an inner housing, introducing a media to the moving air, altering a direction of the air within the fluid passage region using a number of asymmetric vanes located within the fluid passage region, and generating multiple cross sectional vortices at a downstream end of the fluid passage such that the media is preferentially concentrated in a middle portion of an exit stream.

Example 19 includes the method of example 18, wherein the middle portion of the exit stream is concentrated along a line between centers of two vortices.

Example 20 includes the method of any one of examples 18-19, wherein the middle portion of the exit stream is a centroid of the exit stream.

Example 21 includes the method of any one of examples 18-20, wherein generating multiple cross sectional vortices includes deflecting air and media after it passes the number of asymmetric vanes.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects, The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The invention claimed is:

1. A fan assembly, comprising:

a fluid passage region defined between an outer housing and an inner housing;

a fan motor located within the inner housing;

an impeller coupled to the fan motor to drive a fluid through the fluid passage region;

a number of hollow vanes located within the fluid passage region to direct a fluid flow through the fluid passage region; and one or more nozzles located substantially within at least one of the hollow vanes having an outlet positioned to dispense a media within the fluid passage region.

2. The fan assembly of claim 1, wherein the one or more nozzles are positioned to dispense the media from an open trailing edge of at least one of the hollow vanes.

3. The fan assembly of claim 1, wherein the one or more nozzles are configured to dispense a liquid.

4. The fan assembly of claim 3, wherein the one or more nozzles are configured to dispense a super cooled liquid.

5. The fan assembly of claim 3, wherein the one or more nozzles are configured to dispense water.

6. The fan assembly of claim 1, wherein the one or more nozzles are configured to dispense pressurized air.

7. The fan assembly of claim 1, wherein the one or more nozzles are configured to dispense solid particles.

8. The fan assembly of claim 1, herein the one or more nozzles are configured to dispense both liquid and solid particle media.

9. The fan assembly of claim 1, wherein the one or more nozzles are configured for use as a snow making device.

10. The fan assembly of claim 1, wherein the one or more nozzles are configured for use as a dust suppression device.

11. The fan assembly of claim 1, wherein one or more of the inner and outer housing is formed from carbon fiber composite material.

12. A fan assembly, comprising:

a fluid passage region defined between an outer housing and an inner housing;

a fan motor located within the inner housing;

an impeller coupled to the fan motor to drive a fluid through the fluid passage region;

a number of vanes located within the fluid passage region to direct a fluid flow through the fluid passage region; and a vortex generation modifier configured to generating multiple cross sectional vortices at a downstream end of the fluid passage region.

13. The fan assembly of claim 12, wherein the vortex generation modifier includes a number of asymmetric vanes.

14. The fan assembly of claim 12, wherein the vortex generation modifier includes a number of nozzles arranged at angles relative to the fluid passage region.

15. The fan assembly of claim 12, wherein the vortex generation modifier includes multiple fans to generate the multiple cross sectional vortices.

16. The fan assembly of claim 12, wherein the vortex generation modifier includes one or more deflectors.

17. The fan assembly of claim 12, wherein one or more of the inner and outer housing is formed from carbon fiber composite material.

18. A method of dispensing a media, comprising:

moving air through a fluid passage region of a fan assembly, the fluid passage region defined between an outer housing and an inner housing;

introducing a media to the moving air;

altering a direction of the air within the fluid passage region using a number of asymmetric vanes located within the fluid passage region; and generating multiple cross sectional vortices at a downstream end of the fluid passage such that the media is preferentially concentrated in a middle portion of an exit stream.

19. The method of claim 18, wherein the middle portion of the exit stream is concentrated along a line between centers of two vortices.

20. The method of claim 18, wherein the middle portion of the exit stream is a centroid of the exit stream.

21. The method of claim 18, wherein generating multiple cross sectional vortices includes deflecting air and media after it passes the number of asymmetric vanes.

* * * * *